US008375731B2

(12) United States Patent
Kim

(10) Patent No.: US 8,375,731 B2
(45) Date of Patent: Feb. 19, 2013

(54) REFRIGERATOR HAVING WIRING ARRANGEMENT USING INTEGRATED WIRING MODULES

(75) Inventor: Sang-Oh Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 422 days.

(21) Appl. No.: 12/674,084

(22) PCT Filed: Dec. 11, 2007

(86) PCT No.: PCT/KR2007/006425

§ 371 (c)(1),
(2), (4) Date: Feb. 18, 2010

(87) PCT Pub. No.: WO2009/025422

PCT Pub. Date: Feb. 26, 2009

(65) Prior Publication Data

US 2011/0030401 A1 Feb. 10, 2011

(30) Foreign Application Priority Data

Aug. 20, 2007 (KR) ..... 10-2007-0083645

(51) Int. Cl.
*F25B 49/00* (2006.01)

(52) U.S. Cl. ..... 62/126; 62/129

(58) Field of Classification Search ..... 62/126, 62/125, 127, 129; 165/11.1; 318/280, 287, 318/296; 361/643, 7; 362/612
See application file for complete search history.

(56) References Cited

U.S. PATENT DOCUMENTS 4,934,158 A * 6/1990 Sakano ..... 62/239
4,938,027 A * 7/1990 Midlang ..... 62/80
4,970,870 A * 11/1990 Midlang et al. ..... 62/126
5,231,562 A * 7/1993 Pierce et al. ..... 361/832
5,424,720 A * 6/1995 Kirkpatrick ..... 340/585
5,868,195 A * 2/1999 Westbrooks, Jr. ..... 165/267
6,367,273 B2 * 4/2002 Takagi et al. ..... 62/230
6,437,997 B1 * 8/2002 Inarida et al. ..... 363/37

(Continued)

FOREIGN PATENT DOCUMENTS

JP 2001-289549 10/2001
JP 2004-053050 2/2004

(Continued)

OTHER PUBLICATIONS

International Search Report dated May 8, 2008.

*Primary Examiner* — Mohammad Ali
(74) *Attorney, Agent, or Firm* — KED & Associates LLP

(57) ABSTRACT

Disclosed are an integrated wiring module for a refrigerator which is capable of simplifying the wiring of a refrigerator by integrating the various power lines and signal lines conventionally necessary to control a refrigerator into only one line, and a refrigerator having a simplified wiring structure adopting the same. The refrigerator includes integrated wiring modules provided at a refrigerator door connected to a main body board and to each actuator means, wherein the integrated wiring modules are connected to each other only through AC power lines so as to control the door and the respective actuator means, thereby being capable of achieving a door-side zero clearance and sliminess by simplifying the wiring within the refrigerator, reducing an error rate or failure rate which may arise due to the wiring, enhancing the insulating effect by reducing the number of wirings passing through insulation, and reducing the size of a main body board of the refrigerator to thereby increase the capacity of the inner space as by much as the reduced size.

20 Claims, 2 Drawing Sheets

U.S. PATENT DOCUMENTS

| | | | | |
|---|---|---|---|---|
| 6,525,506 | B2 * | 2/2003 | Jin | 318/801 |
| 6,715,302 | B2 * | 4/2004 | Ferragut, II | 62/129 |
| 6,755,037 | B2 * | 6/2004 | Engel et al. | 62/177 |
| 6,927,871 | B1 * | 8/2005 | Silverbrook et al. | 358/1.15 |
| 7,269,968 | B2 * | 9/2007 | Harder et al. | 62/389 |
| 7,404,298 | B2 * | 7/2008 | Kim et al. | 62/126 |
| 7,515,292 | B2 * | 4/2009 | Silverbrook et al. | 358/1.15 |
| 7,543,897 | B2 * | 6/2009 | Kim | 312/405 |
| 2001/0009360 | A1 * | 7/2001 | Jin | 318/801 |
| 2001/0035018 | A1 * | 11/2001 | Takagi et al. | 62/228.4 |
| 2003/0090890 | A1 * | 5/2003 | Miozza et al. | 362/92 |
| 2003/0182957 | A1 * | 10/2003 | Hu et al. | 62/228.4 |
| 2005/0198991 | A1 * | 9/2005 | Harder et al. | 62/389 |
| 2006/0117820 | A1 * | 6/2006 | Lanigan et al. | 70/279.1 |
| 2006/0179870 | A1 * | 8/2006 | Byrne et al. | 62/408 |

FOREIGN PATENT DOCUMENTS

| | | |
|---|---|---|
| KR | 10-2005-0014683 | 2/2005 |

* cited by examiner

REFRIGERATOR HAVING WIRING ARRANGEMENT USING INTEGRATED WIRING MODULES

TECHNICAL FIELD

The present invention relates to a refrigerator, and more particularly, to an integrated wiring module for a refrigerator which is capable of simplifying the wiring of a refrigerator by integrating various conventionally employed power and signal lines necessary to control the refrigerator into only one line, and to a refrigerator having a simplified wiring arrangement implementing the same.

BACKGROUND ART

In general, a side-by-side type refrigerator is provided with a wiring arrangement in which a refrigerator main body is divided into a freezing chamber and a cooling chamber, and various load equipments such as a display unit, a manipulation panel, a fan motor, a compressor, etc. are mounted at an upper or lower portion of the refrigerator. Here, each of the load equipments may be disposed, according to its characteristic, at an outside of the refrigerator, in particular, at a front surface of a door.

Each of such load equipments is connected to a main control board disposed in the main body through a freezing chamber lead wire and a cooling chamber lead wire. Here, the lead wires are arranged to lay close to an inner side surface of an inner case by blown-in insulation filled between the inner case and an outer case.

FIG. 1 is a schematic block diagram showing the construction of a wiring arrangement (i.e., wiring loom or harness) of a related art side-by-side type refrigerator.

Referring to FIG. 1, there may be provided doors 101, 102 having a manipulation panel (not shown) or a display unit (not shown) displaying a variety of information required for controlling the refrigerator, a main body board 103 controlling an overall operation of the refrigerator according to commands inputted through the manipulation panel, and an actuator unit 104 having a plurality of actuator means to perform an operation to be controlled by the main body board. An insulation 105 may further be provided between the refrigerator main body board 103 and the actuator unit 104.

Here, a micro-computer (not shown) performing an operation algorithm of the refrigerator is mounted within the main body board 103. When a user manipulates the manipulation panel, the micro-computer detects the manipulation signal and performs a pre-set algorithm according to the corresponding manipulation command, thereby controlling the corresponding component of the refrigerator.

In addition, the actuator means may include a fan, a heater, a compressor, a lamp and a speaker. Recently, the actuator means may also include an Internet appliance, a TV, a monitor for radio reception and a communication means.

Each of such actuator means 104 uses a different power source (alternating current (AC) or direct current (DC)). Since various signal lines for transmitting the control signals should be connected to the main body board 103, its wiring becomes complicated. Also, a plurality of wirings (e.g., a thick wiring harness) must pass through the space between the main body board 103 and the insulation 105, causing a deterioration of the insulating effect thereof.

In addition, the many wirings make it difficult to reduce the size of the main board as well as increase the possibilities for erroneous wiring. Further, the refrigerator may not work properly due to the erroneous wiring.

DISCLOSURE OF INVENTION

Technical Problem

Therefore, it is an object of the present invention to provide an integrated wiring module which is capable of achieving a door-side zero clearance and slimness by simplifying the wiring within a refrigerator, and a wiring arrangement for a refrigerator implementing the same.

It is another object of the present invention to provide an integrated wiring module which is capable of enhancing an insulating effect by simplifying the wiring within a refrigerator so as to reduce the number of wirings passing through an insulation, and a wiring structure for a refrigerator implementing the same.

It is another object of the present invention to provide an integrated wiring module which is capable of reducing the size of a refrigerator main body board by simplifying various wirings within a refrigerator, and a wiring structure for a refrigerator implementing the same.

Further, it is another object of the present invention to provide an integrated wiring module which can increase the capacity of the inner space of a refrigerator by as much as the reduction in size of a main body board by simplifying the wiring within the refrigerator so as to reduce the size of the main body board, and a wiring structure for a refrigerator implementing the same.

To achieve this and other advantages and in accordance with the purpose of the present invention, as embodied and broadly described herein, a refrigerator according to one embodiment of the present invention includes integrated wiring modules provided at a refrigerator door connected to a main body board and each actuator means, wherein the integrated wiring modules are connected to each other through AC power lines so as to control the door and the respective actuator means.

Here, the integrated wiring module rectifies AC power applied through the AC power line so as to generate DC power required for circuit driving, and communicates with the main body board so as to send and receive signals related to the performance of various control functions.

Further, the integrated wiring module includes a DC power unit for receiving AC power to generate a DC voltage of a certain level required for circuit driving, a signal transmitting unit driven by the DC power generated by the DC power unit and for modulating/demodulating various signals required to perform a control function using the AC power so as to communicate with the main body board, and a micro-computer for communicating with the main body board through the signal transmitting unit, and with such communication, controlling a specific load of a refrigerator.

Technical Solution

The present application discloses an integrated wiring module for a refrigerator which is capable of simplifying the wiring of a refrigerator by integrating the various power lines and signal lines conventionally necessary to control a refrigerator into only one line, and a refrigerator having a simplified wiring structure adopting the same.

Advantageous Effects

The present invention can achieve a door-side zero clearance and slimness by simplifying the wiring within a refrigerator.

Also, the present invention can reduce an error rate or failure rate which may be caused by a wiring, by simplifying the wiring within the refrigerator.

Further, the present invention can enhance insulating effect by reducing a number of wirings passing through the insulation, by simplifying the wiring within the refrigerator.

In addition, the present invention can reduce the size of a main body board of the refrigerator by simplifying various wirings within the refrigerator, thus to increase the capacity of the inner space of the refrigerator.

MODE FOR THE INVENTION

Figure 1:
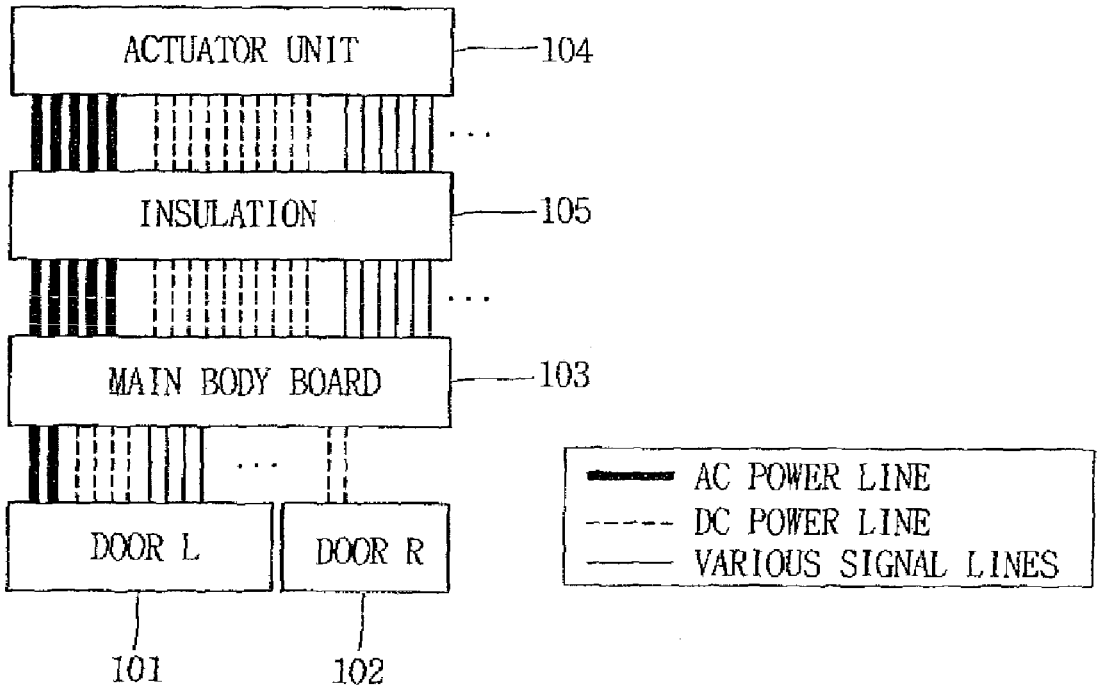
FIG. 1 is a schematic block diagram showing the construction of a wiring arrangement of a related art side-by-side refrigerator.

Description will now be given in detail of the preferred embodiments of the present invention, examples of which are illustrated in the accompanying drawings. In explaining the present invention with reference to the drawings, the same reference numerals will be given to those components performing the same function.

Figure 2:
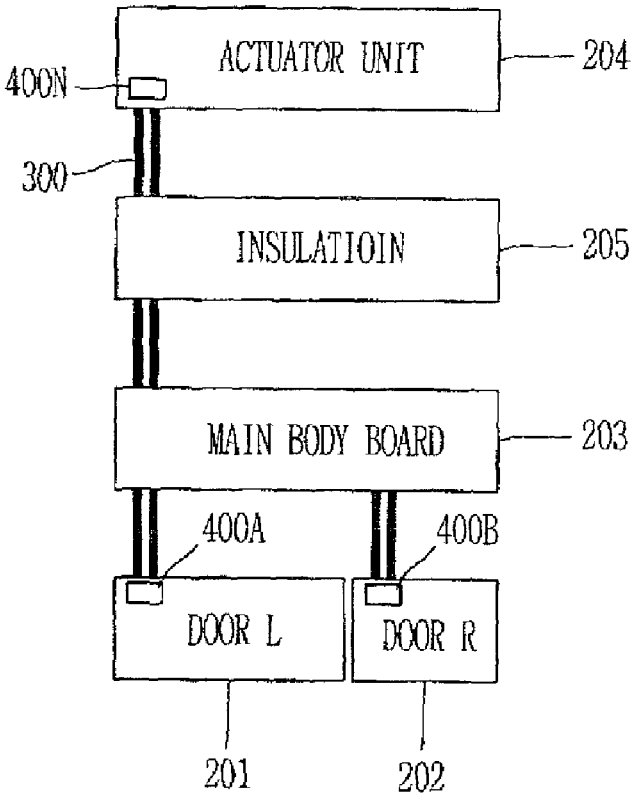
FIG. 2 is a schematic block diagram showing a wiring structure for a refrigerator using an integrated wiring module according to one embodiment of the present invention.

FIG. 2 is a schematic block diagram showing a wiring arrangement of a refrigerator using an integrated wiring module according to one embodiment of the present invention. As shown in FIG. 2, a refrigerator main body board 203, doors 201 and 202 connected to the main body board 203, and an actuator unit 204 are configured to be connected to each other only through AC power lines 300, excluding various signal lines and DC power lines.

For such a wiring connection, integrated wiring modules 400A~400N are respectively provided at the main body board 203 and at each of the components 201~204. The integrated wiring modules rectify the AC power applied through the AC power lines 300 to generate the DC power required for circuit driving, and communicate with the main body board 203 to send and receive various signals related to the performance of control functions.

Since the integrated wiring modules 400A~400N of the present invention generate the DC power required for circuit driving by themselves, the need for a power line for DC power distribution may be eliminated, thereby simplifying the wiring. Also, since the integrated wiring modules 400A~400N modulate/demodulate signals required to perform control functions through the AC power lines for sending and receiving the signals, the need for various additional signal lines can also be eliminated, thus to simplify the wiring.

Further, the wiring harness can be configured with only the AC power lines, eliminating any DC power lines or any signal lines, thereby occupying less space and having little influence on the passage of the insulation around the wiring harness, thus to reduce the impact on the insulating effect thereof. The AC power lines may additionally be provided with wiring according to the concerned actuator means (e.g., linear compressor); however, when compared to the related art, the inclusion of additional DC power line or signal line is not required, thereby not influencing on the effect of the present invention.

Figure 3:
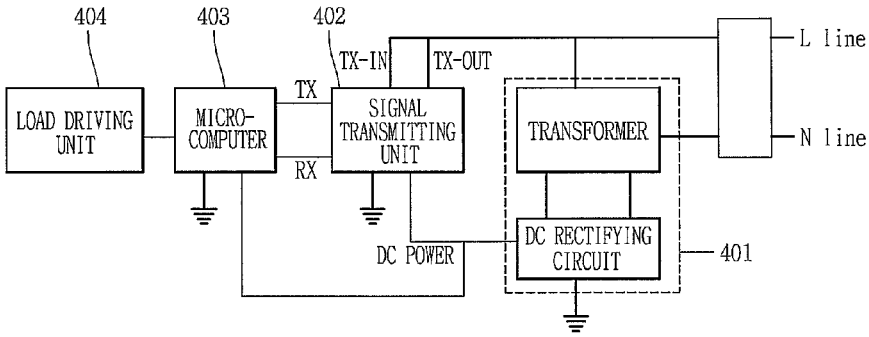
FIG. 3 is a schematic block circuit diagram showing the construction of an integrated wiring module according to one embodiment of the present invention.

FIG. 3 is a schematic block diagram showing the construction of the integrated wiring module according to one embodiment of the present invention. Referring to FIG. 3, there are provided a DC power unit 401 receiving supplied AC power to generate a DC voltage of a certain level required for circuit driving, a signal transmitting unit 402 driven by the DC power generated by the DC power unit 401 and communicating with a main body board by modulating/demodulating various signals required to perform a control function through the AC power line, and a micro-computer 403 communicating with the main body board 203 through the signal transmitting unit 402, and by such communication, controlling a specific load of a refrigerator.

The refrigerator loads may include a fan, a display, a compressor, a heater, a three-way valve, a damper, a solenoid valve, and the like.

Here, a load driving unit 404 for driving at least one of such loads may be further provided under the control of the micro-computer 403.

And, a module mounted in the main body board 203 may further have one or more communication ports for communicating with each of the components. A micro-computer (not shown) disposed on the main body board 203 is configured to operate as a master, and micro-computers disposed on each of the modules 400A~400N are configured to operate as slaves.

Figure 4:
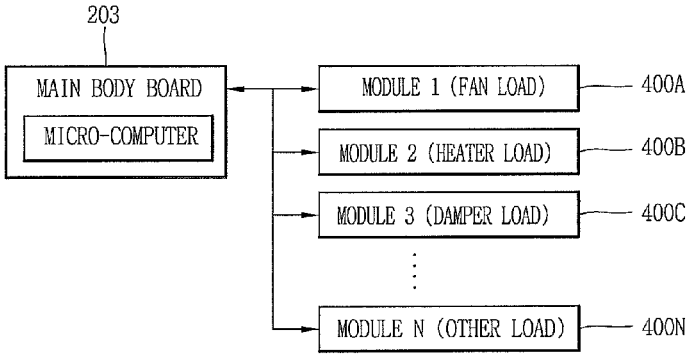
FIG. 4 is an exemplary view showing a communication method between a main body board and each component using the integrated wiring module according to the present invention.

FIG. 4 is an exemplary view showing a communication method between the main body board and each component using the integrated wiring module according to the present invention. As shown in the drawing, the modules mounted at each of the components are supplied with AC power and operate by generating a DC voltage of a certain level required for circuit driving.

Here, the micro-computers 403 of the integrated wiring modules 400A~400N control the signal transmitting unit 402 to establish a communication path(port) with the main body board 203. Once such communication ports are established, various control commands transmitted from the main body board 203 may be received to control an operation of the corresponding load, without needing to use a separate signal line.

For instance, if a user manipulates a manipulation panel (not shown) disposed outside the door 201 to set a lower temperature of a freezing chamber, the integrated wiring module provided at the door 201 is configured to modulate a corresponding manipulation signal value and to transmit the modulated value to the main body board 203 through the AC power line.

Thereafter, the micro-computer (not shown) provided in the main body board 203 demodulates and interprets the manipulation signal received via the AC power line, modulates a compressor control signal to lower the temperature of the freezing chamber and transmits the modulated control signal via the AC power line to that integrated wiring module which is capable of driving a certain compressor of the actuator unit 204.

Then, the micro-computer 403 of the integrated wiring module which is capable of driving the compressor demodulates and interprets the compressor control signal received via the AC power line, and then controls the operation of the corresponding compressor through the load driving unit 404 of the compressor.

As the present invention may be embodied in several forms without departing from the spirit or essential characteristics thereof, it will be apparent to those skilled in the art that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, and equivalents of such metes and bounds are therefore intended to be embraced by the appended claims.

The invention claimed is:

1. A refrigerator, comprising:

a door;

a control board;

at least one actuator;

alternating current (AC) power lines; and at least one integrated wiring module electrically connected to the control board through one or more of the AC power lines, wherein:

one or more functions of the refrigerator are controlled based on control signals transmitted between the integrated circuit wiring module and control board through one or more of the AC power lines, and a controller coupled to the control board is configured to operate as a master and a controller of the integrated wiring module is configured to operate as a slave in performing the one or more functions of the refrigerator.

2. The refrigerator of claim 1, wherein:

the integrated wiring module converts AC power received from one of the AC power lines into direct current (DC) power for circuit driving, the integrated wiring module rectifying the AC power applied through said one of the AC power lines to generate the DC power required for circuit driving.

3. The refrigerator of claim 1, wherein the integrated wiring module comprises:

a DC power converter to rectify the AC power to generate DC power of a certain level required for circuit driving; and a signal transmitter driven by the DC power generated by the DC power converter and for transmitting control signals required for performance of the one or more functions of the refrigerator the controller of the integrated wiring module communicating with the control board based on the control signals transmitted by the signal transmitter.

4. The refrigerator of claim 1, wherein the integrated wiring module is further provided with a load driver to drive a specific load under the control of the controller of the master controller.

5. The refrigerator of claim 1, wherein the control board is further provided with one or more communication ports.

6. The refrigerator of claim 1, wherein:

no DC power lines are between the control board and the integrated wiring module and between the control board and the actuator, and said one or more of the AC power lines are the only lines used to carry control signals for performing the one or more functions of the refrigerator.

7. The refrigerator of claim 1, wherein the integrated wiring module is coupled to a circuit of the door and wherein the circuit of the door is to perform the one or more functions of the refrigerator.

8. The refrigerator of claim 1, wherein the one or more functions of the refrigerator corresponds to a function of a display, user control panel, LAN, TV, radio or communication device.

9. The refrigerator of claim 7, wherein:

the integrated wiring module includes a power converter to convert AC power received from one of the AC power lines into direct current (DC) power, and the DC power is to drive a circuit of the door.

10. The refrigerator of claim 1, wherein the integrated wiring module is coupled to a circuit of the actuator and wherein the circuit of the actuator is to perform the one or more functions of the refrigerator.

11. The refrigerator of claim 10, wherein the actuator corresponds to one of a fan, compressor, valve, heater, or damper.

12. The refrigerator of claim 10, wherein:

the integrated wiring module includes a power converter to convert AC power received from one of the AC power lines into direct current (DC) power, and the DC power is to drive a circuit of the actuator.

13. A refrigerator, comprising:

an actuator;

a control board for controlling an operation of a refrigerator;

at least one integrated wiring module communicating with the control board to control the actuator and to supply power for circuit driving; and a wiring harness for electrically connecting the control board and the integrated wiring module through AC power lines, wherein:

a controller coupled to the control board is configured to operate as a master and a controller of the integrated wiring module is configured to operate as a slave in performing the one or more functions of the refrigerator, and the integrated wiring module converts AC power received from one of the AC power lines into DC power for said circuit driving.

14. The refrigerator of claim 13, wherein the integrated wiring module rectifies the AC power supplied through the wiring harness so as to generate the DC power required for circuit driving and wherein the circuit to be driven corresponds to the actuator.

15. The refrigerator of claim 13, wherein the integrated wiring module comprises:

a power converter to generate the DC power by rectifying the AC power supplied through the wiring harness; and a signal transmitter to transmit signals required to control the actuator or a load of the refrigerator different from the actuator.

16. The refrigerator of claim 15, wherein the integrated wiring module is further provided with a load driver to drive the actuator or a specific load of the refrigerator under the control of the master controller.

17. An apparatus for a refrigerator, comprising:

a control board including a master controller;

a wiring module including a slave controller; and a plurality of alternating current (AC) lines, at least a portion of the AC lines coupled between the control board and the wiring module, wherein the wiring module includes:

a power converter to convert AC power received from one of the AC lines into direct current (DC) power, and a signal transceiver to receive control signals from or transmit control signals to the control board through one or more of the AC lines, wherein the control signals are to control a predetermined function of the refrigerator and wherein no DC power lines are included for between the wiring module and the control board.

18. The apparatus of claim 17, wherein the predetermined function is a function of an actuator of the refrigerator.

19. The refrigerator of claim 17, wherein the actuator is one of a fan, compressor, valve, heater, or damper.

20. The apparatus of claim 17, wherein the predetermined function corresponds to a function of a display, user control panel, LAN, TV, radio or communication device.

* * * * *